US008471481B2

(12) United States Patent
Shin et al.

(10) Patent No.: US 8,471,481 B2
(45) Date of Patent: Jun. 25, 2013

(54) LIGHTING APPARATUS USING PN JUNCTION LIGHT-EMITTING ELEMENT AND DIMMING METHOD THEREOF

(75) Inventors: Sang Hyun Shin, Gyeonggi-do (KR); Seon Ho Kim, Gyeonggi-do (KR)

(73) Assignee: Wooree Lighting Co., Ltd., Gyeonggi-do (KR)

( * ) Notice: Subject to any disclaimer, the term of this patent is extended or adjusted under 35 U.S.C. 154(b) by 224 days.

(21) Appl. No.: 13/081,616

(22) Filed: Apr. 7, 2011

(65) Prior Publication Data

US 2012/0217877 A1 Aug. 30, 2012

(30) Foreign Application Priority Data

Feb. 25, 2011 (KR) ..... 10-2011-0016994

(51) Int. Cl.
*H05B 37/00* (2006.01)
*H05B 39/00* (2006.01)
*H05B 41/00* (2006.01)

(52) U.S. Cl.
USPC ..... 315/185 R; 315/192; 315/193

(58) Field of Classification Search
None
See application file for complete search history.

(56) References Cited

U.S. PATENT DOCUMENTS 5,663,719 A * 9/1997 Deese et al. ..... 340/912
7,081,722 B1 * 7/2006 Huynh et al. ..... 315/323
7,891,853 B2 2/2011 Park
2006/0197469 A1 9/2006 Kim
2009/0135592 A1 * 5/2009 Hamada ..... 362/231

FOREIGN PATENT DOCUMENTS

| | | |
|---|---|---|
| JP | 2003-059335 | 2/2003 |
| JP | 2008-041546 | 2/2008 |
| KR | 10-2006-0094767 | 8/2006 |
| KR | 100926040 | 11/2009 |
| KR | 1020100052629 | 5/2010 |
| KR | 10-2010-0101355 | 9/2010 |

OTHER PUBLICATIONS

PCT International Search Report dated May 16, 2012 from PCT Application No. PCT/KR2011/008361 filed Nov. 4, 2011 which claims the same priority as the instant application; 2 pgs.
English Summary of a Korean Patent Office Action for the priority Korean Patent Application No. 10-2011-0016994; 2 pgs.

* cited by examiner

*Primary Examiner* — Anh Tran
(74) *Attorney, Agent, or Firm* — Harness, Dickey & Pierce, P.L.C.

(57) ABSTRACT

The present disclosure discloses a dimming method of a lighting apparatus using a PN junction light-emitting element, the method including: supplying AC controlled by a dimmer; causing a first group, which has one PN junction light-emitting element positioned within a first boundary and one PN junction light-emitting element positioned within a second boundary, to emit light at a first voltage by the supplied AC when a first switch is in the ON state; and causing a second group, which has another PN junction light-emitting element positioned within the first boundary and another PN junction light-emitting element positioned within the second boundary and which is connected in series to the first group, to emit light at a second voltage higher than the first voltage by the supplied current when the first switch positioned between the first group and the second group is in the OFF state.

10 Claims, 6 Drawing Sheets

Prior Art

Prior Art

LIGHTING APPARATUS USING PN JUNCTION LIGHT-EMITTING ELEMENT AND DIMMING METHOD THEREOF

CROSS-REFERENCE TO RELATED APPLICATIONS

This application claims the benefit and priority of Korean patent Application No. KR-10-2011-0016994, filed Feb. 25, 2011. The entire disclosure of the above application is incorporated herein by reference.

FIELD

This disclosure, in general, relates to a lighting apparatus using a PN junction light-emitting element and a dimming method thereof, and more particularly, to a lighting apparatus using a PN junction light-emitting element, which uses AC and can be used together with a dimmer, and a dimming method thereof.

BACKGROUND

This section provides background information related to the present disclosure which is not necessarily prior art.

FIG. 1 is a view showing an example of a conventional lighting apparatus. The lighting apparatus 9 is directly connected to an AC power source 1 without using a separate drive circuit, and LEDs 2, 3 and 4 and LEDs 5, 6 and 7 are connected in parallel with their polarities reversed. Voltage is adjusted as needed via a resistor 8. The LEDs 5, 6 and 7 emit light when a positive (+) voltage is applied thereto, and the LEDs 2, 3 and 4 emit light when a negative (−) voltage is applied thereto.

Such a lighting apparatus is advantageous in that an LED lighting apparatus can be easily implemented without using a separate drive circuit for converting AC into DC, but poses a problem in the use of a dimmer (see FIG. 2). For instance, if light is dimmed to 5V when 10V is required to drive the LEDs 5, 6 and 7, no current conduction occurs. If a dimmer adapted to set the conduction time by on/off is used, the LEDs 5, 6 and 7 basically emit no light at 10V or less, so that their emission time is limited. In addition, the conduction time limitation imposed by the dimmer may cause problems such as flickering.

SUMMARY

This section provides a general summary of the disclosure and is not a comprehensive disclosure of its full scope or all of its features.

According to one aspect of the present disclosure, there is provided a dimming method of a lighting apparatus using a PN junction light-emitting element, the method including: supplying AC controlled by a dimmer; causing a first group, which has one PN junction light-emitting element positioned within a first boundary and one PN junction light-emitting element positioned within a second boundary, to emit light at a first voltage by the supplied AC when a first switch is in the ON state; and causing a second group, which has another PN junction light-emitting element positioned within the first boundary and another PN junction light-emitting element positioned within the second boundary and which is connected in series to the first group, to emit light at a second voltage higher than the first voltage by the supplied current when the first switch positioned between the first group and the second group is in the OFF state.

Further areas of applicability will become apparent from the description provided herein. The description and specific examples in this summary are intended for purposes of illustration only and are not intended to limit the scope of the present disclosure.

DESCRIPTION OF DRAWINGS

The drawings described herein are for illustrative purposes only of selected embodiments and not all possible implementations, and are not intended to limit the scope of the present disclosure.

DETAILED DESCRIPTION

The present disclosure will now be described in detail with reference to the accompanying drawings.

Figure 1:
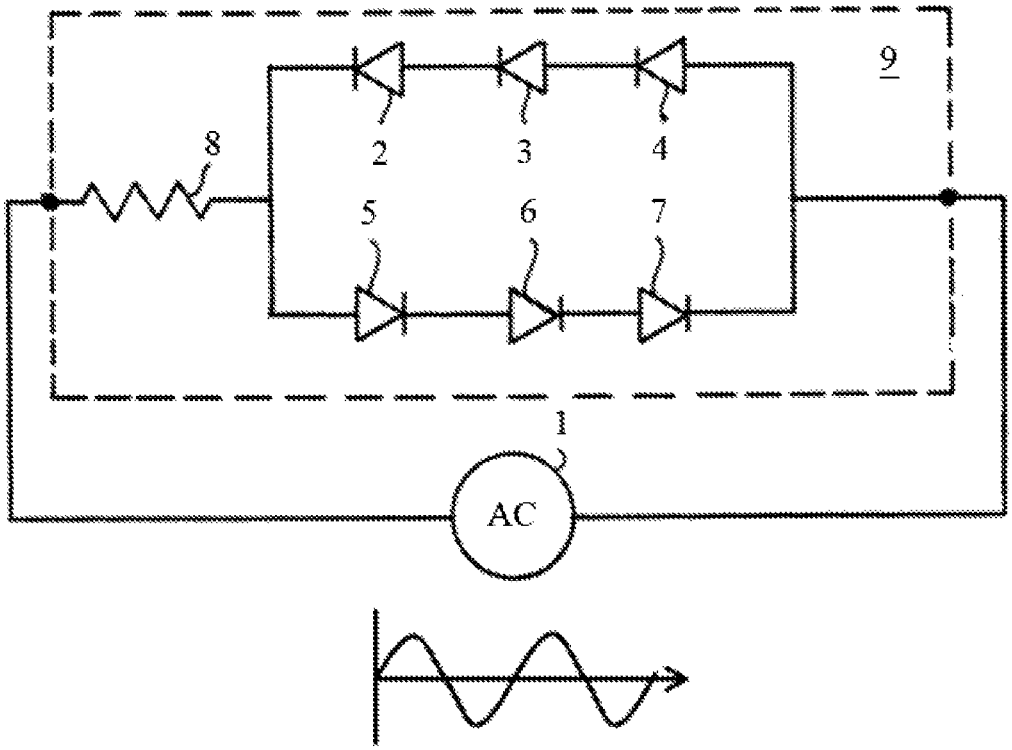
FIG. 1 is a view showing an example of a conventional lighting apparatus.
Figure 2:
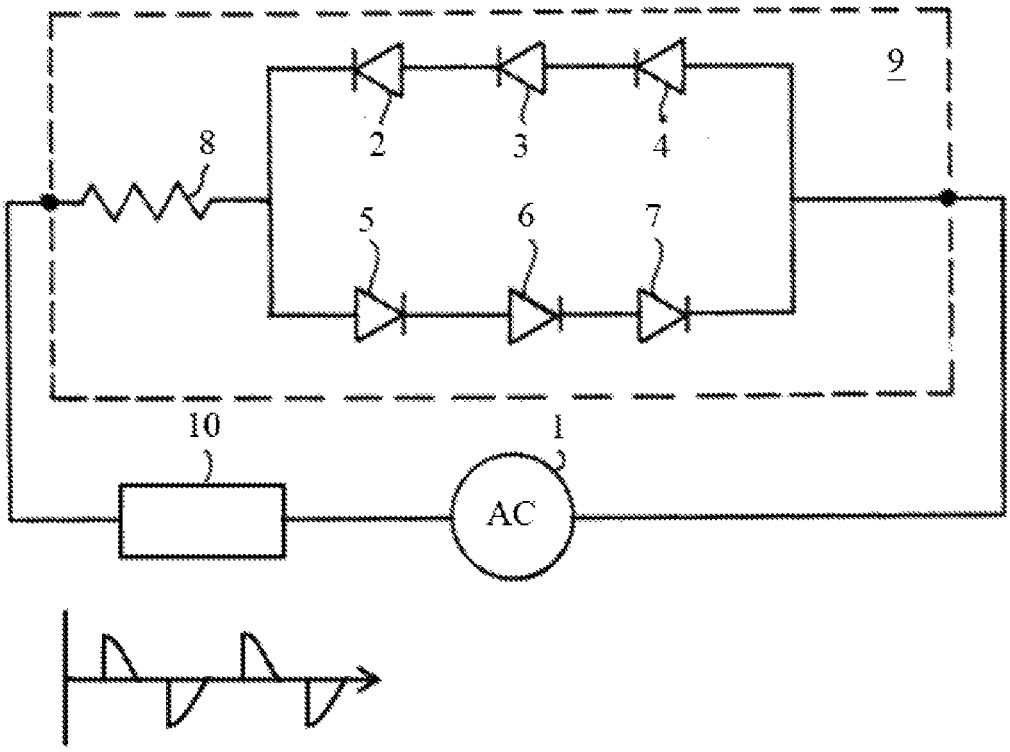
FIG. 2 is a view showing an example of a conventional lighting apparatus equipped with a dimmer.
Figure 3:
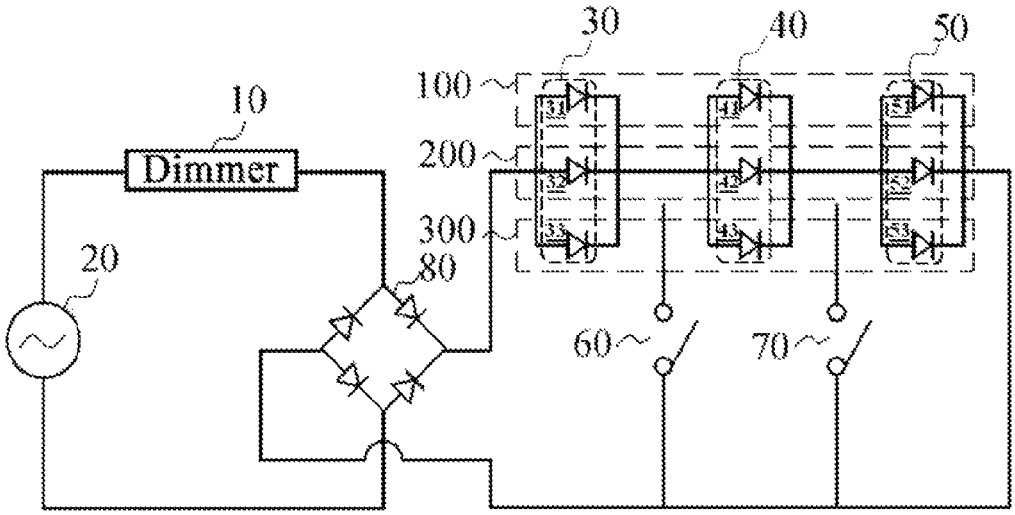
FIG. 3 is a view showing an example of a lighting apparatus using a PN junction light-emitting element according to the present disclosure.

FIG. 3 is a view showing an example of a lighting apparatus using a PN junction light-emitting element according to the present disclosure. The lighting apparatus includes a dimmer 10, an AC power source 20, LEDs 31, 32 and 33 of a first group 30, LEDs 41, 42 and 43 of a second group 40, LEDs 51, 52 and 53 of a third group 50, a switch 60 positioned between the first group 30 and the second group 40, a switch 70 positioned between the second group 40 and the third group 50, and a rectifying circuit 80 including a bridge diode. The rectifying circuit 80 removes the necessity of disposing the LEDs in both directions as in FIGS. 1 and 2. The number of groups is not limited, but a minimum of two groups is required. LEDs within one group may be connected in parallel or in series.

Figure 4:
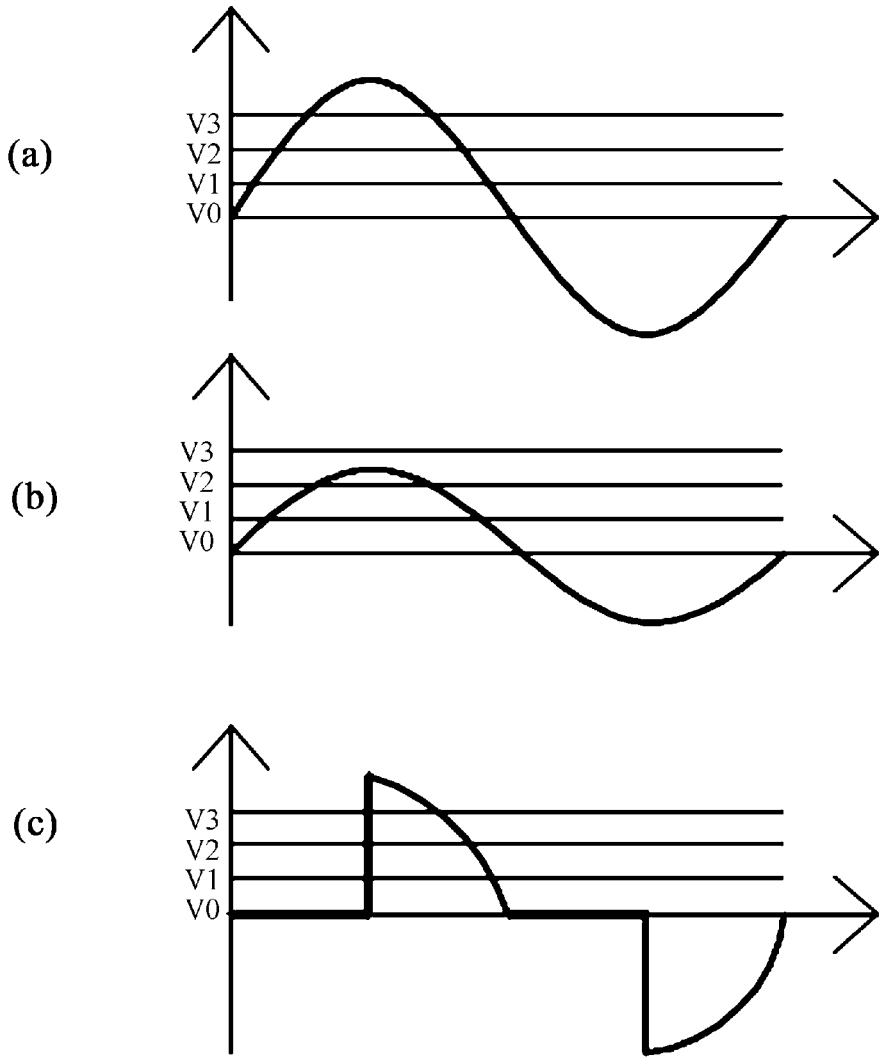
FIG. 4 is a view for explaining changes of the AC voltage caused by the application of a dimmer.

As shown in FIG. 4*a*, when the AC voltage reaches V1, the LEDs 31, 32 and 33 of the first group 30 can emit light. At this point, if the switch 60 is in the ON state, this causes AC to flow, thus enabling the first group 30 to emit light. Moreover, when the AC voltage reaches V2, the LEDs 41, 42 and 43 of the second group can emit light. At this point, if the switch 60 is in the OFF state and the switch 70 is in the ON state, the first group 30 and the second group 40 can emit light. In addition, when the AC voltage reaches V3, the LEDs 51, 52 and 53 of the third group 50 can emit light. If the switch 60 and the switch 70 are in the OFF state, the first group 30, the second group 40, and the third group 50 can emit light.

As shown in FIG. 4*b*, if the maximum voltage is set to a value between V2 and V3 by the dimmer, light emission occurs only in the first group 30 and the second group 40 while no light emission occurs in the third group 50. In the present disclosure, the LED 31 of the first group 30, the LED 41 of the second group 40, and the LED 51 of the third group 50 are included in a first boundary 100, the LED 32 of the first group 30, the LED 42 of the second group 42, and the LED 52 of the third group 50 are included in a second boundary 200, and the LED 33 of the first group 30, the LED 43 of the second group 40, and the LED 53 of the third group 50 are included in a third boundary 300, so that light emission occurs in all of the first boundary 100, second boundary 200 and third boundary 300 positioned throughout the lighting apparatus even if the third group 50 emits no light due to dimming. A boundary may be defined, for example, by a package. That is, the LED 31 in the first boundary 100, the LED 32 in the second boundary 200, and the LED 33 in the third boundary 300 emit light at an AC voltage of V1 or more, and the LEDs 31 and 41 in the first boundary 100, the LEDs 32 and 42 in the second boundary 200, and the LEDs 33 and 43 in the third boundary 300 emit light at an AC voltage of V2. The brightness of this emission is rather low because there is no section where all of the three LEDs within one boundary emit light. Nevertheless, light emission occurs dimmed over the entire lighting apparatus.

As shown in FIG. 4*c*, if dimming is performed by adjusting the conduction time, light is emitted only during half of a period of the AC voltage, thus reducing the overall amount of light. Nevertheless, light emission occurs dimmed over the entire lighting apparatus.

Figure 5:
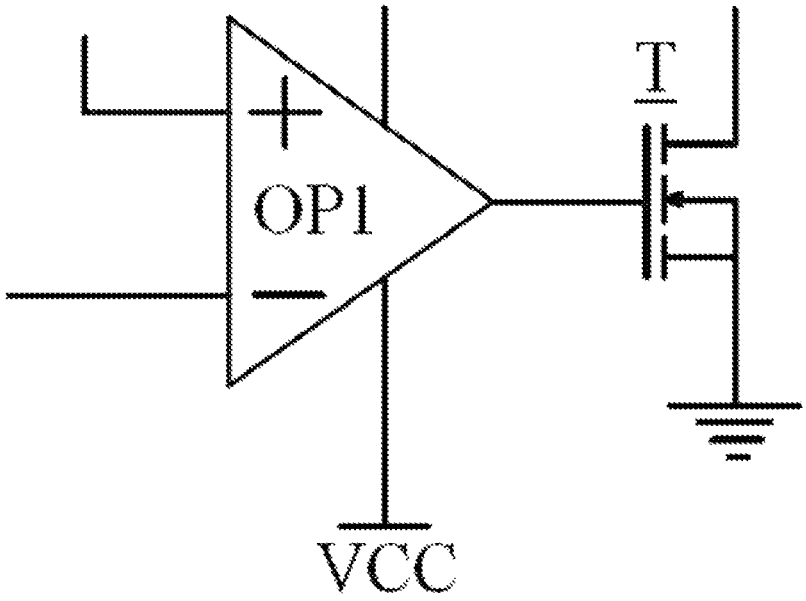
FIG. 5 is a view showing an example of the configuration of a switch.

FIG. 5 is a view showing an example of the configuration of a switch. The switches 60 and 70 of FIG. 2 can be easily implemented by using an OP-amp comparator OP1 for sensing whether the magnitude of an AC voltage of a switching transistor T reaches V1, V2 and V3, respectively.

Figure 6:
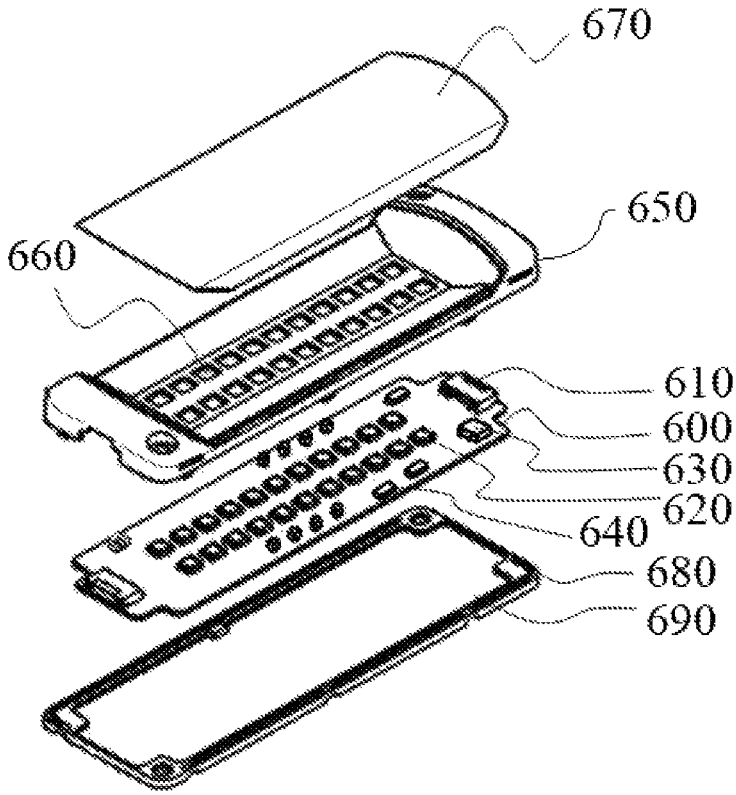
FIG. 6 is a view showing an example of a lighting apparatus using a PN junction light-emitting element which uses a package according to the present disclosure.

FIG. 6 is a view showing an example of a lighting apparatus using a PN junction light-emitting element which uses a package according to the present disclosure. The lighting apparatus using the PN junction light-emitting element includes a power transmitting substrate 600. The power transmitting substrate 600 includes a connector 610 supplied with dimmed current, a package 620 having a plurality of PN junction light-emitting element chips embedded therein, and circuit elements 630 and 640 for switching operation, etc. A top cover 650 having openings 660 that corresponds to the package 620 is formed over the power transmitting substrate 600. Preferably, a transparent lens 670 is further provided. A bottom cover 680 is positioned under the power transmitting substrate 600, and the power transmitting substrate 600 is received in a receiving slot 690 of the bottom cover 680 in a contacting manner. Heat generated from the package 620 is discharged to the outside via the bottom cover 680. The receiving slot 690 serves to reduce the thickness of the bottom cover 680, which makes heat dissipation easier. The top cover 650 with the openings 660 permits light emission while easily covering the circuit elements 630 and 640 despite they are provided on the light-emitting side.

Hereinafter, various exemplary embodiments of the present disclosure will be described.

(1) A dimming method of a lighting apparatus using a PN junction light-emitting element, the method including: supplying AC controlled by a dimmer; causing a first group, which has one PN junction light-emitting element positioned within a first boundary and one PN junction light-emitting element positioned within a second boundary, to emit light at a first voltage by the supplied AC when a first switch is in the ON state; and causing a second group, which has another PN junction light-emitting element positioned within the first boundary and another PN junction light-emitting element positioned within the second boundary and which is connected in series to the first group, to emit light at a second voltage higher than the first voltage by the supplied current when the first switch positioned between the first group and the second group is in the OFF state.

The dimmer is a means for adjusting the brightness of the lighting apparatus by changing the supplied power, and may employ a method of adjusting the voltage or a method of adjusting the conduction time (e.g., SCR, TRIAC, etc.) as shown in FIG. 2.

A typical example of the PN junction light-emitting element is a light-emitting diode (LED), and another example thereof may include a laser diode (LD).

The first boundary may be defined by one package having a plurality of chips, or by a plurality of chips provided on one substrate, or simply by disposing a plurality of chips or a package in one area. However, it is preferable to use one package to improve the degree of integration of the chips and in consideration of wiring to be required later.

(2) A dimming method of a lighting apparatus using a PN junction light-emitting element, wherein, in the first group, one PN junction light-emitting element positioned within the first boundary and one PN junction light-emitting element positioned within the second boundary are connected in parallel, and in the second group, another PN junction light-emitting element positioned within the first boundary and another PN junction light-emitting element positioned within the second boundary are connected in parallel. Although PN junction light-emitting elements in a group may be connected either in series or in parallel, the lighting apparatus can more sensitively respond to dimming when they are connected in parallel. For instance, if three PN junction light-emitting elements (which emit light at 3V) are provided in a group, 3V is required for parallel connection while 9V is required for serial connection, and they can respond to the dimmer in units of 3V, not in units of 9V.

(3) A dimming method of a lighting apparatus using a PN junction light-emitting element, wherein the second group emits light when the second switch is in the ON state. This means that a group of PN junction light-emitting elements may be added as needed.

(4) A dimming method of a lighting apparatus using a PN junction light-emitting element, wherein the second boundary is defined by another package, and the package defining the first boundary and the package defining the second boundary are spaced apart from each other on a power transmitting substrate. With this configuration, light can be emitted uniformly over the entire lighting apparatus according to changes in AC power despite the application of a dimmer.

(5) A dimming method of a lighting apparatus using a PN junction light-emitting element, wherein the first switch is positioned on the power transmitting substrate, and the first group and the second group emit light via openings which are provided on a top cover positioned over the power transmitting substrate and covering the first switch and which correspond to the light emission of the first group and the light emission of the second group, respectively. This is a preferred embodiment of the lighting apparatus according to this disclosure. With this configuration, the lighting apparatus can emit light without any restrictions caused by a structural change of the first switch, etc. accompanied by the use of the dimmer.

(6) A dimming method of a lighting apparatus using a PN junction light-emitting element, wherein the method includes discharging heat, which is generated from the first group and the second group, via a bottom cover contacting the power transmitting substrate. The bottom cover is brought into contact with the power transmitting substrate to discharge heat. Therefore, even when the output of the dimmer increases, heat can be easily dissipated without the aid of a heat sink.

In the lighting apparatus using the PN junction light-emitting element and the dimming method thereof according to one aspect of the present disclosure, it is possible to provide a lighting apparatus which is suitable to use AC with dimming.

Additionally, in the lighting apparatus using the PN junction light-emitting element and the dimming method thereof according to another aspect of the present disclosure, it is possible to emit dimmed light uniformly over the entire lighting apparatus.

Moreover, in the lighting apparatus using the PN junction light-emitting element and the dimming method thereof according to a further aspect of the present disclosure, it is possible to effectively dissipate heat even with a high output from the dimmer.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

What is claimed is:

1. A dimming method of a lighting apparatus using a PN junction light-emitting element, the method comprising:

supplying AC controlled by a dimmer;

causing a first group, which has one PN junction light-emitting element positioned within a first boundary and one PN junction light-emitting element positioned within a second boundary, to emit light at a first voltage by the supplied AC when a first switch is in the ON state; and causing a second group, which has another PN junction light-emitting element positioned within the first boundary and another PN junction light-emitting element positioned within the second boundary and which is connected in series to the first group, to emit light at a second voltage higher than the first voltage by the supplied current when the first switch positioned between the first group and the second group is in the OFF state, wherein the first boundary is defined by one package.

2. The method of claim 1, wherein, in the first group, one PN junction light-emitting element positioned within the first boundary and one PN junction light-emitting element positioned within the second boundary are connected in parallel, and wherein, in the second group, another PN junction light-emitting element positioned within the first boundary and another PN junction light-emitting element positioned within the second boundary are connected in parallel.

3. The method of claim 1, wherein the second group emits light when a second switch is in the ON state.

4. The method of claim 1, wherein the second boundary is defined by another package, and the package defining the first boundary and the package defining the second boundary are spaced apart from each other on a power transmitting substrate.

5. The method of claim 4, wherein the first switch is positioned on the power transmitting substrate, and the first group and the second group emit light via openings which are provided on a top cover positioned over the power transmitting substrate and covering the first switch and which correspond to the light emission of the first group and the light emission of the second group, respectively.

6. The method of claim 5, wherein, in the first group, one PN junction light-emitting element positioned within the first boundary and one PN junction light-emitting element positioned within the second boundary are connected in parallel, and wherein, in the second group, another PN junction light-emitting element positioned within the first boundary and another PN junction light-emitting element positioned within the second boundary are connected in parallel.

7. The method of claim 1, wherein the first boundary and the second boundary are positioned on the power transmitting substrate, and the first group and the second group emit light via openings which are provided on a top cover positioned over the power transmitting substrate and covering the first switch and which correspond to the light emission of the first group and the light emission of the second group, respectively.

8. The method of claim 7, wherein the method comprises discharging heat, which is generated from the first group and the second group, via a bottom cover contacting the power transmitting substrate.

9. The method of claim 1, wherein the method comprises discharging heat, which is generated from the first group and the second group, via a bottom cover contacting the power transmitting substrate.

10. The method of claim 1, wherein the second boundary is defined by another package, and wherein, in the first group, one PN junction light-emitting element positioned within the first boundary and one PN junction light-emitting element positioned within the second boundary are connected in parallel, and wherein, in the second group, another PN junction light-emitting element positioned within the first boundary and another PN junction light-emitting element positioned within the second boundary are connected in parallel, and wherein, the second group emits light when a second switch is in the ON state.

* * * * *